US008469764B2

(12) United States Patent
Weber

(10) Patent No.: US 8,469,764 B2
(45) Date of Patent: Jun. 25, 2013

(54) TOY BUILDING CONSTRUCTION SET

(76) Inventor: Eliyahu Weber, Jerusalem (IL)

( * ) Notice: Subject to any disclaimer, the term of this patent is extended or adjusted under 35 U.S.C. 154(b) by 99 days.

(21) Appl. No.: 12/717,149

(22) Filed: Mar. 4, 2010

(65) Prior Publication Data

US 2010/0221976 A1 Sep. 2, 2010

Related U.S. Application Data

(63) Continuation-in-part of application No. PCT/IL2008/001223, filed on Sep. 15, 2007.

(51) Int. Cl.
*A63H 33/08* (2006.01)

(52) U.S. Cl.
USPC ..... 446/124; 446/121

(58) Field of Classification Search
USPC ..... 473/105–128; 273/156, 160, 241, 273/276, 290, 449, 450; 446/105–128
See application file for complete search history.

(56) References Cited

U.S. PATENT DOCUMENTS

| | | | | | |
|---|---|---|---|---|---|
| 669,029 | A | * | 2/1901 | Faller | 446/122 |
| 2,799,118 | A | * | 7/1957 | Lullo | 446/112 |
| 2,799,188 | A | | 7/1957 | Lullo | |
| 3,374,917 | A | | 3/1968 | Troy | |
| 3,415,007 | A | * | 12/1968 | Howe | 446/124 |
| 3,696,548 | A | | 10/1972 | Teller | |
| 3,803,754 | A | | 4/1974 | Fischer | |
| 4,129,975 | A | * | 12/1978 | Gabriel | 52/655.2 |
| 4,566,246 | A | | 1/1986 | Sanger | |
| 4,571,200 | A | * | 2/1986 | Serna | 446/85 |
| 4,676,762 | A | * | 6/1987 | Ballard | 446/104 |
| 5,069,647 | A | * | 12/1991 | Zuviria | 446/127 |
| 5,199,919 | A | * | 4/1993 | Glickman | 446/126 |
| 5,282,767 | A | * | 2/1994 | Gelardi | 446/126 |
| 5,788,555 | A | * | 8/1998 | Glynn | 446/124 |
| 5,803,782 | A | * | 9/1998 | Selton | 446/126 |
| 5,941,527 | A | * | 8/1999 | Selton | 273/276 |
| 6,672,789 | B2 | * | 1/2004 | Chen | 403/171 |
| 7,267,598 | B2 | * | 9/2007 | Glickman | 446/124 |
| 7,827,940 | B2 | * | 11/2010 | Silverman | 119/474 |

FOREIGN PATENT DOCUMENTS

| | | |
|---|---|---|
| CA | 2239386 | 9/1999 |
| EP | 891797 | 1/1999 |
| GB | 2058587 | 4/1981 |
| SE | 512148 | 1/2001 |

* cited by examiner

*Primary Examiner* — Nini Legesse
(74) *Attorney, Agent, or Firm* — Edward Langer Adv. and Patent Attorney

(57) ABSTRACT

In one aspect, the present invention is directed to a toy building construction set, comprising: pieces in the form of bars 4 and pieces in the form of corresponding connectors 6, for simulating a concrete skeleton, wherein: each of the bars having only male connecting members at the end thereof; each of the connectors having at each facet thereof a female connecting member corresponding to the male connecting member; and a connection of each of the bars to each of the connectors is concealed. The set may further comprise a casing for storing the pieces of the set. The casing may comprise a scale for indicating the number of floors that can be built by the remaining pieces in the casing.

18 Claims, 9 Drawing Sheets

TOY BUILDING CONSTRUCTION SET

CROSS-REFERENCE TO RELATED APPLICATIONS

This application is a continuation-in-part of PCT International Application No. PCT/IL2008/001223, which has an international filing date of Sep. 15, 2007, and which claims priority to, and the benefit of, Israel Patent Application No. 186078, filed Sep. 19, 2007, the entirety of which is incorporated herein by reference.

FIELD OF THE INVENTION

The present invention relates to the field of toy building construction sets. More particularly, the invention relates toy building pieces for use in children's construction sets.

BACKGROUND OF THE INVENTION

Presently toy building construction sets are well, and in fact long known. Such sets usually comprise a plurality of pieces with connection means used to form toy buildings and other toy/miniature structures.

Although this principle is common in various toy building sets, no current toy building set has been directed to impart to infants the foundations required for step-by-step construction, especially the concept of the loads on the constructed elements.

It is an object of the present invention to provide a toy building construction set, upon which the construction foundations are imparted.

Furthermore, in a toy building constructed from myriad pieces, it is also important that the constructed building will look like a real construction as much as possible. Prior art sets fail to provide this character.

It is a further object of the present invention to provide a toy building construction set, from which the final toy constructions look like a real construction more than in prior art building construction sets.

Other objects and advantages of the invention will become apparent as the description proceeds.

SUMMARY OF THE INVENTION

The following embodiments and aspects thereof are described and illustrated in conjunction with systems, tools and methods, which are meant to be merely illustrative, not limiting in scope. In various embodiments, one or more of the above-described problems have been reduced or eliminated, while other embodiments are directed to other advantages or improvements.

In one aspect, the present invention is directed to a toy building construction set, comprising:

- pieces in the form of bars 4 and pieces in the form of corresponding connectors 6, for simulating a concrete skeleton, wherein:
- each of the bars having only male connecting members at the end thereof;
- each of the connectors having at each facet thereof a female connecting member corresponding to the male connecting member; and
- a connection of each of the bars to each of the connectors is concealed.

In one embodiment of the invention, the male connecting member 44 comprises at least one vane 22, and the female connecting member 28 comprises corresponding depression(s), thereby enforcing connecting a bar (of said plurality of bars) to a connector (of said connectors) in a desired angle therebetween.

According to one embodiment of the invention, the male connecting member 44 comprises a stud 24. The stud may be of a cylindrical form, prismatic form, quadratic prism form, and so forth.

According to one embodiment of the invention, each of the pieces has at least one groove along the piece and at least one groove across the piece.

The set may further comprise a plurality of quadrate and/or rectangular tablets, to be placed such that the grooves of the surrounding pieces are used as a frame thereof.

Preferably, the latitudinal contour of at least one of the pieces is quadrate, but the contour may be also rectangular.

In embodiments of the invention, at least one facet of the pieces thereof is divided by grooves into bricks-like forms. Preferably the brick-like forms are of 1×1 cm.

The set may further comprise a lamp-like piece. The lamp-like piece may have a male connecting member corresponding to the female connecting member of a connector.

The set may further comprise a casing for storing the pieces of the set. The casing may comprise a scale for indicating the number of floors that can be built by the remaining pieces in the casing.

In addition to the exemplary aspects and embodiments described above, further aspects and embodiments will become apparent by reference to the figures and by study of the following detailed description.

BRIEF DESCRIPTION OF THE DRAWINGS

The objects and features of the present invention will become apparent from the following detailed description considered in conjunction with the accompanying drawings, in which.

Each of FIGS. 1 and 2 schematically illustrates a toy building model formed from a construction set, according to one embodiment of the invention.

Figure 3A:
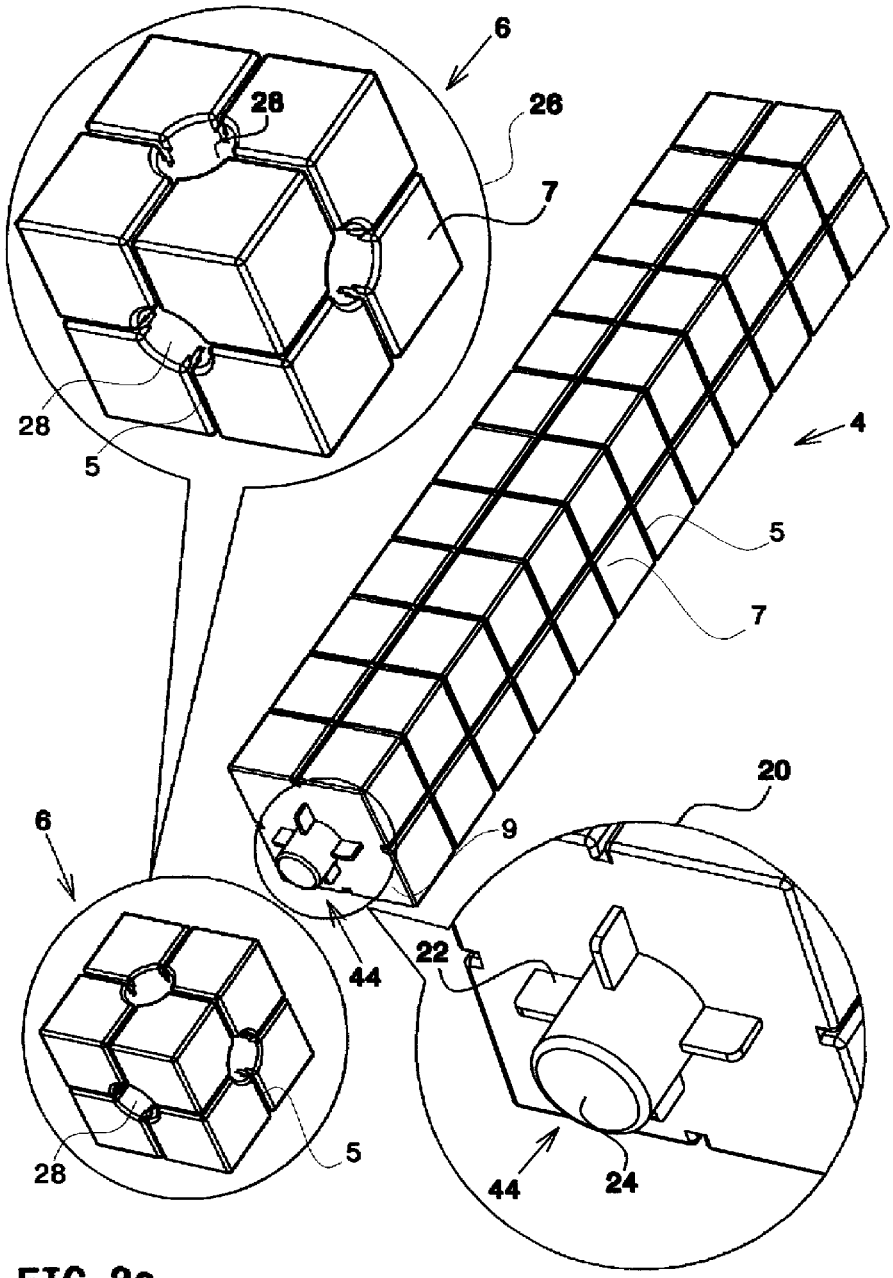
FIGS. 3 to 11 schematically illustrate the structure of the pieces of the building illustrated in FIGS. 1 and 2.
Figure 3B:
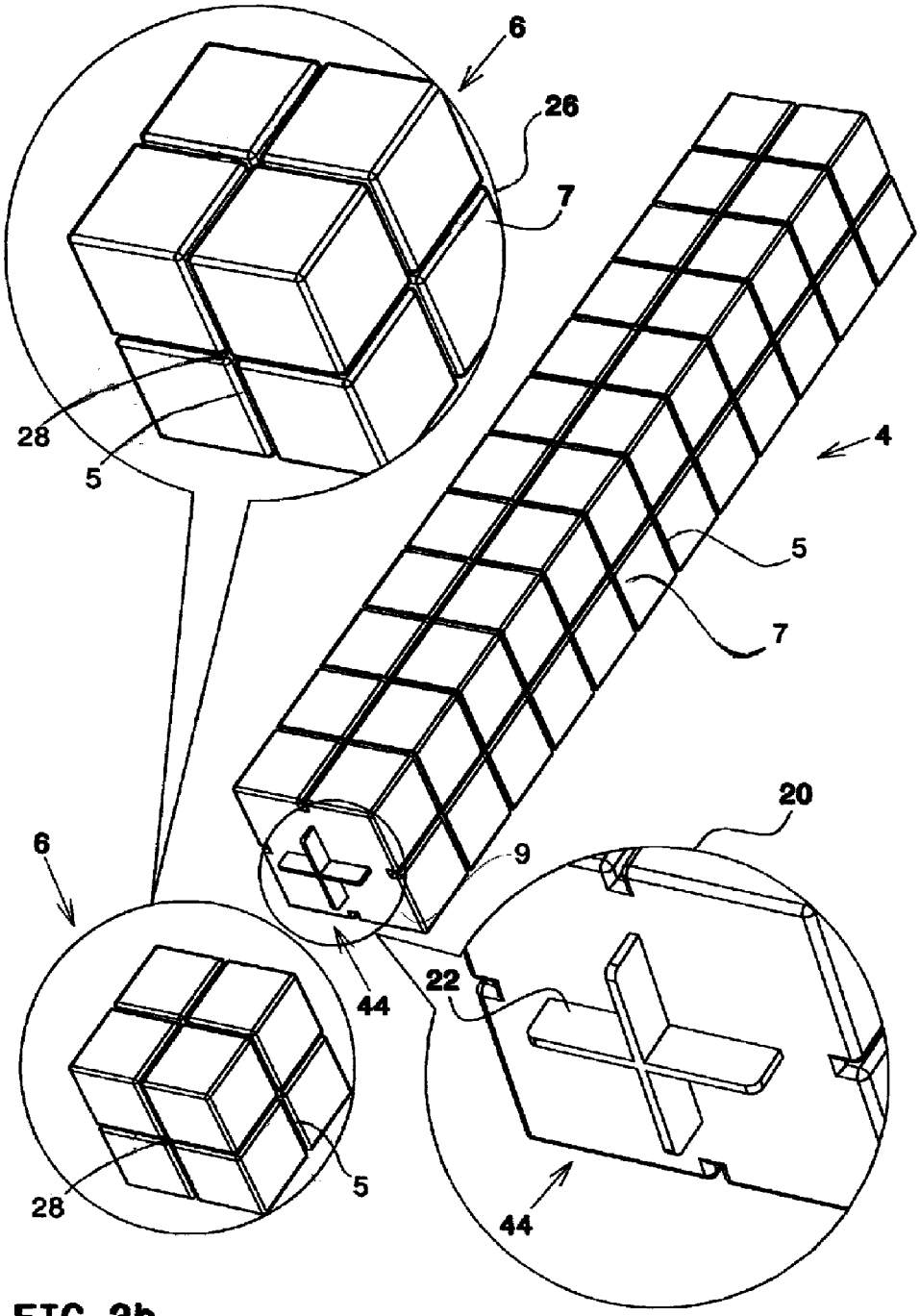

Each of FIGS. 3*a* and 3*b* schematically illustrates the structure of a bar and a connecting member thereof, according to one embodiment of the invention.

Figure 4:
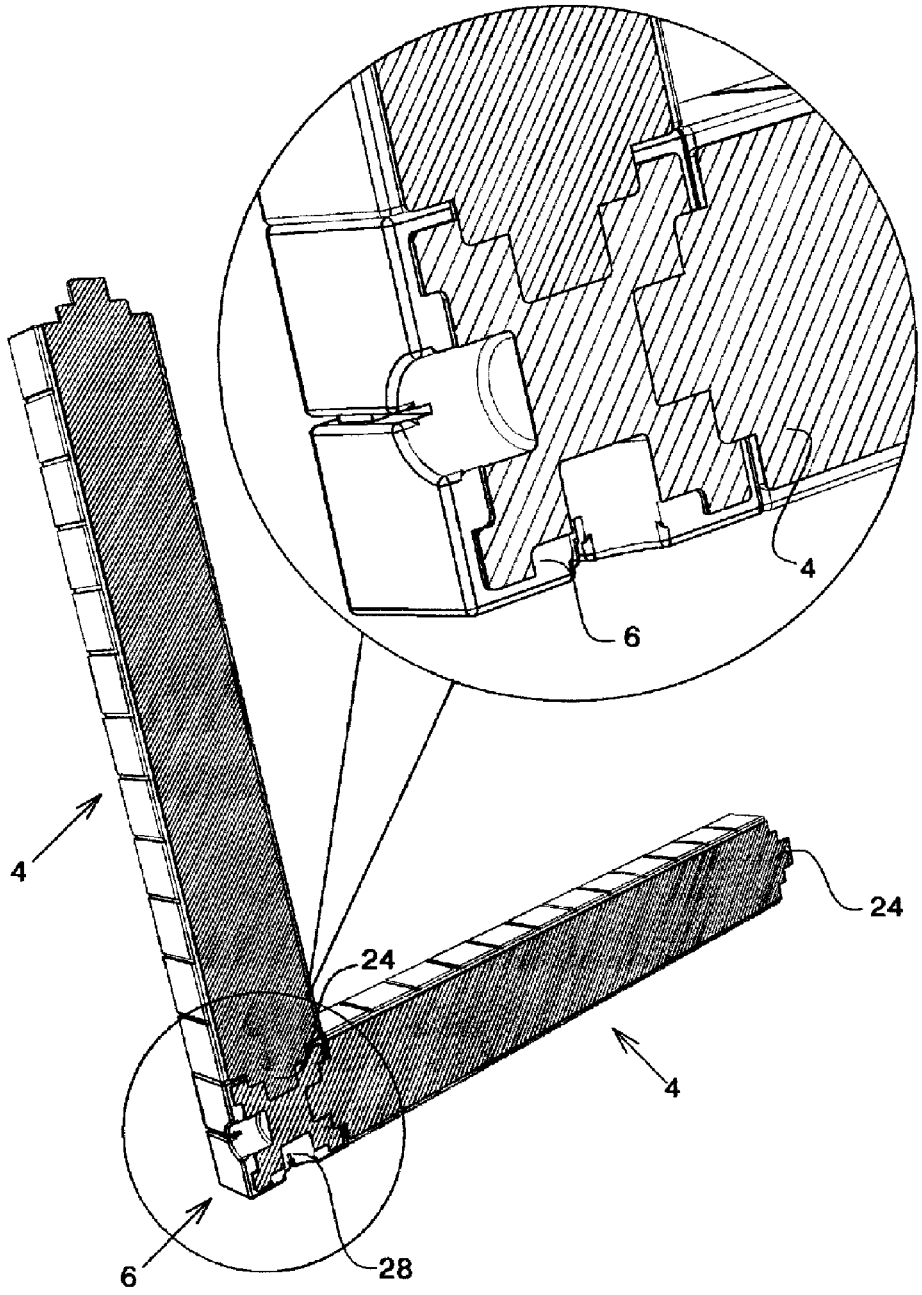

FIG. 4 is a cross-section along two connected bars 4, which schematically illustrates a connection mechanism according to one embodiment of the invention.

Figure 5:
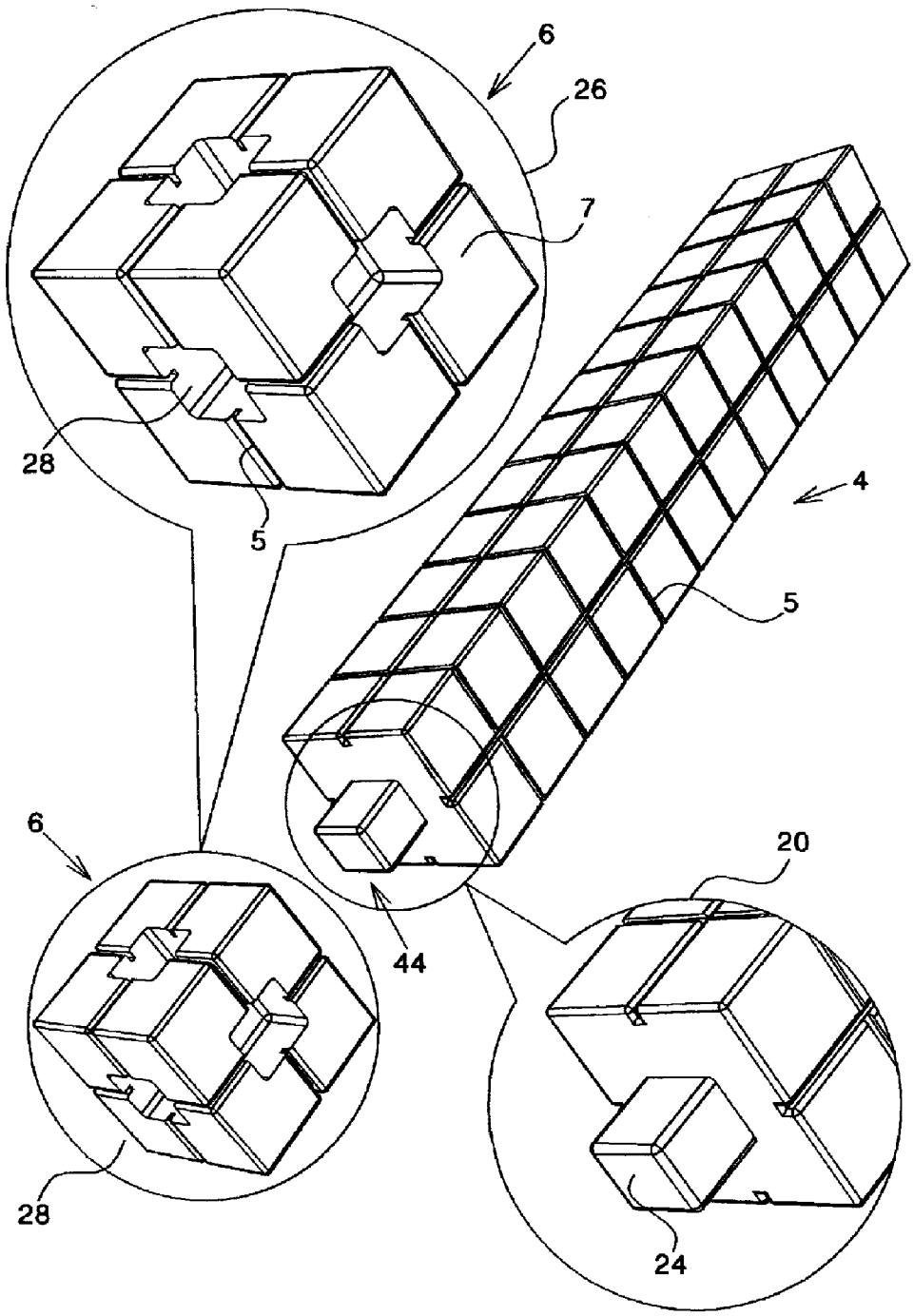

FIG. 5 schematically illustrates the structure of a bar 4 and a connecting member 6, according to another embodiment of the invention.

Figure 1:
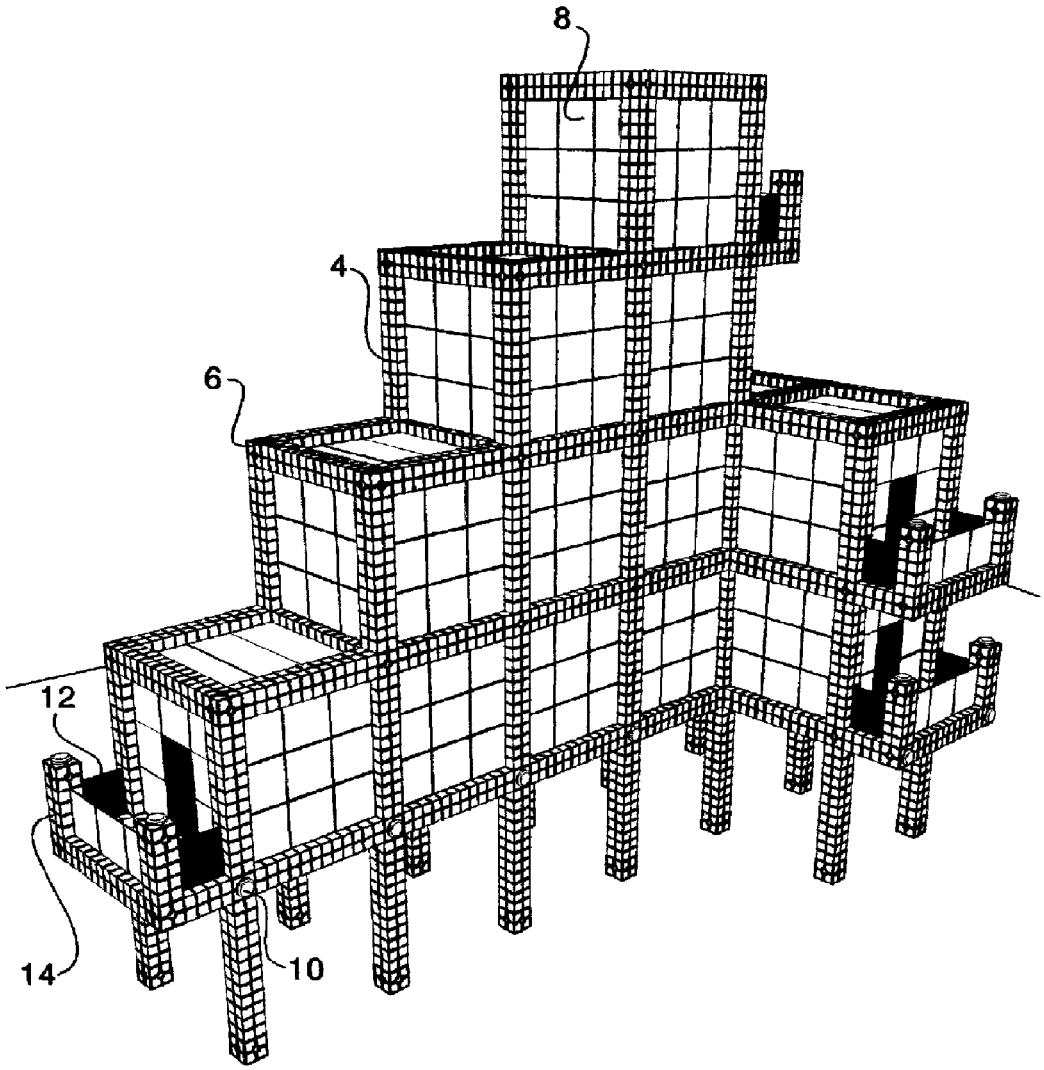
Figure 2:
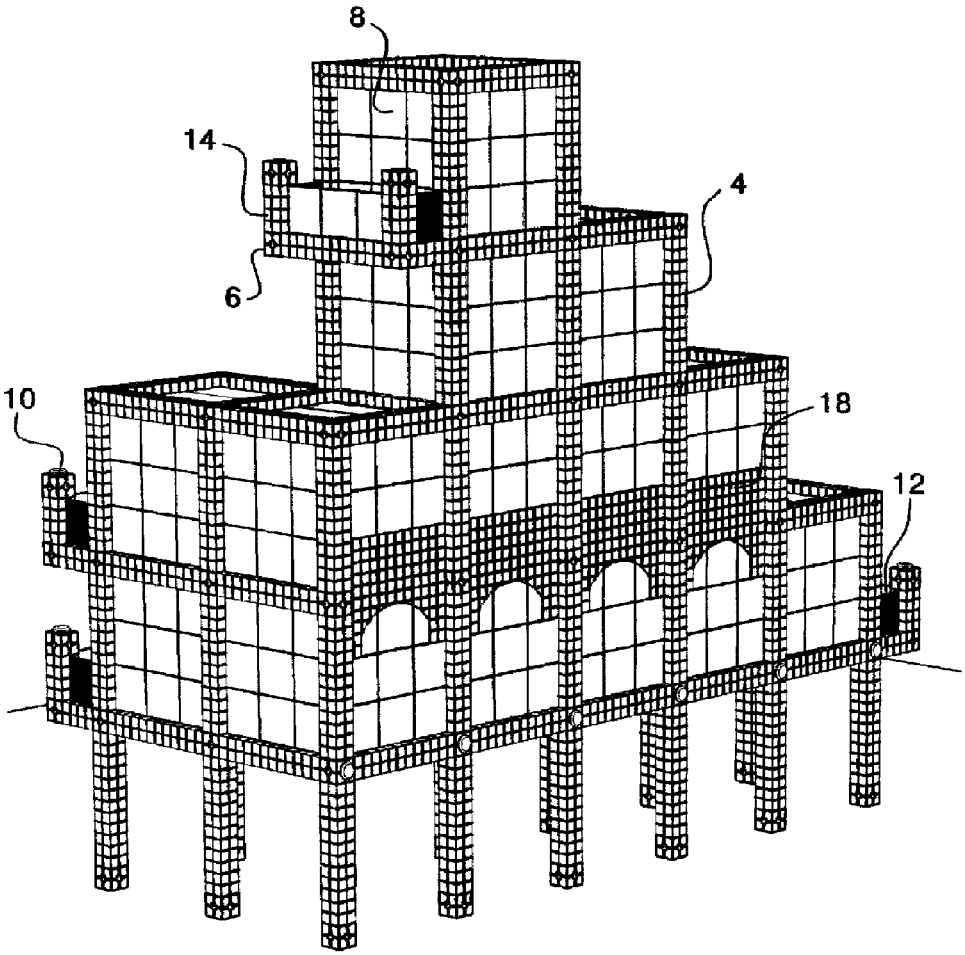
Figure 6:
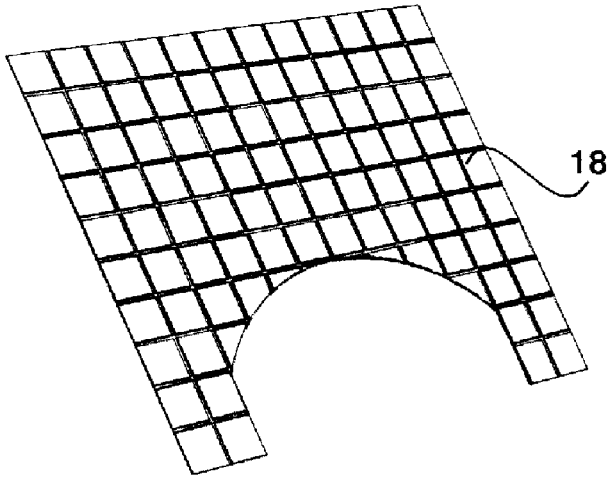

FIG. 6 schematically illustrates the arch piece 18 of FIGS. 1 and 2, according to one embodiment of the invention.

Figure 7:
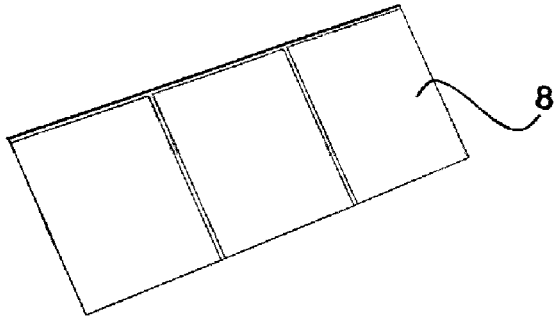

FIG. 7 schematically illustrates the "wall" piece 8 of FIGS. 1 and 2, according to one embodiment of the invention.

Figure 8:
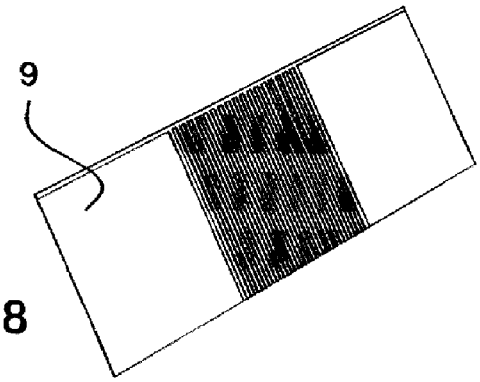

FIG. 8 schematically illustrates a "wall" piece 9, according to one embodiment of the invention.

Figure 9:
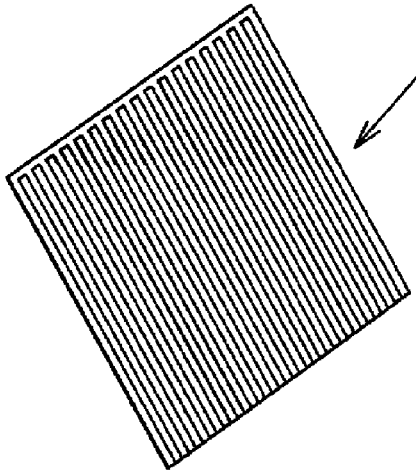

FIG. 9 schematically illustrates a "wall" piece 12, according to one embodiment of the invention.

Figure 10:
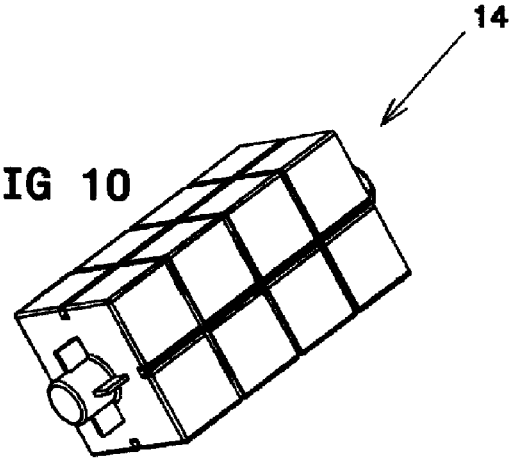

FIG. 10 schematically illustrates a bar 14, according to one embodiment of the invention.

Figure 11B:
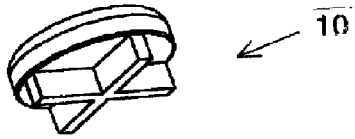
Figure 11A:
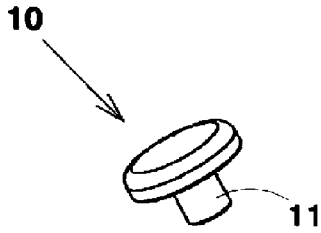

Each of FIGS. 11*a* and 11*b* schematically illustrates a "lamp" piece 10, according to one embodiment of the invention.

Figure 12:
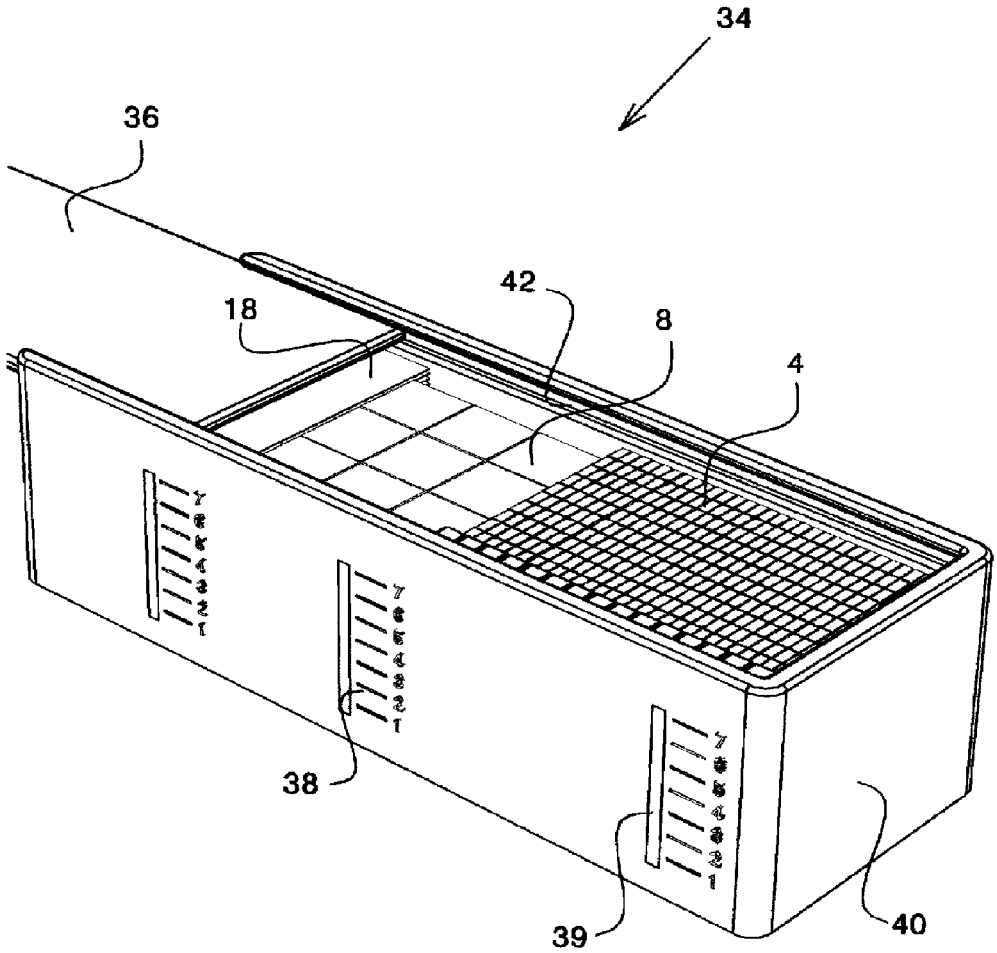

FIG. 12 schematically illustrates a casing 34, for a toy building construction set.

It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein. Reference numerals may be repeated among the figures in order to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In some instances, well-known methods, procedures, components and circuits have not been described in detail, for the sake of clarity.

The term "piece" refers herein to a basic construction element in a toy building construction set, which can be assembled and connected to other construction elements. Lego pieces™, for example, consist of colorful interlocking plastic pieces and an accompanying array of gears, minifigures (also called "minifigs" by Lego fans), and various other parts.

Pieces are successfully used and enjoyed by children, normally above the age of five. Pieces are commonly made of a safe, semi-plastic material of a relatively large, easily handled size. They are provided with snap-in features which facilitate assembly and prevent inadvertent disintegration.

Each of FIGS. 1 and 2 schematically illustrates a toy building model formed from a toy building construction set, according to one embodiment of the invention. FIG. 1 is the rear view thereof, and FIG. 2 is the front view thereof.

Bar pieces 4 comprise the major part of the set, which are referred to herein simply as "bars". As illustrated, some bars 4 are deployed vertically, and some horizontally.

Each of two adjacent bars 4 are connected by a connecting piece 6, which is also referred to herein as "connectors". As illustrated in these figures, the connection between the bars is concealed.

The bars and the connectors allow constructing a skeleton. The quadrate form of the bars and the connection technique between two bars, which conceals the connection points, allow demonstrating a concrete-like skeleton, in order to impart foundations of building construction to an infant player.

Also illustrated in FIGS. 1 and 2 is a plurality of tablets 8, which are used as walls. Preferably, the size of the edge of a tablet 8 corresponds to the size of a bar 4.

An additional piece illustrated in FIGS. 1 and 2 is a guardrail 12 of a porch, which is actually a tablet. Numeral 10 denotes a piece used as a lamp and the like.

FIGS. 3 to 11 schematically illustrate the structure of the pieces of the building illustrated in FIGS. 1 and 2.

The basic pieces forming the construction are bars 4, and the connectors 6. Preferably, the connectors are designed such that upon connecting two bars, it will appear to be a single piece, regardless whether the bars are connected subsequently or perpendicularly.

The term "column" refers herein to a vertical bar in a toy construction, and the term "beam" refers herein to a horizontal bar in a construction. Thus, a bar 4 may be used as a column and also as a beam.

The higher the construction, the higher is the load on the lower parts thereof. As a result, in a construction the columns must be massive with regard to the expected load.

In the real world—as opposed to that of the miniature—columns and beams are made of wood, metal, reinforced concrete, and the like.

FIG. 3*a* schematically illustrates the structure of a bar 4 and a connecting member 6, according to one embodiment of the invention.

A connector 6 is used to connect two bars 4. The bars may be connected perpendicularly or subsequently.

According to this embodiment of the invention, the object of the design of the bars and the connectors is to allow connecting each of two bars such that the connection is concealed, thereby providing to the construction an appearance which departs from a construction made of myriad pieces. In order to achieve this object, the contour of the ends of a bar 6 and the connecting member 4 must be substantially the same.

According to embodiments of the invention, the connection technology is based on mating elements. This is a well-known technology. According to such technology, one of the mating elements is referred to as "male" and the other as "female". In the illustrations herein, numeral 44 denotes a "male" connecting element, and numeral 28 denotes a "female" connecting element. Numeral 20 denotes a zoomed view on the "male" connecting element 44.

According to this embodiment of the invention, the male connecting element comprises a stud 24 (an element projecting from a surface), and four vanes 22. The stud 24 is the part which mates with the corresponding female member 28. Vanes 22 are used to enforce the means by which a bar is connected to a connector. In the example of FIG. 3, the planes of the facets and the bars and the connector will be parallel upon connection.

Of course, other mechanisms may be employed in order to achieve this object, such as a rectangular contour of the stud 24, and corresponding form of element 28.

According to a preferred embodiment of the present invention, the contour of the end 9 of bar 4 is quadratic. According to another embodiment of the present invention, the end 9 of bar 4 is rectangular.

The size of bar 4 illustrated in FIG. 3 is 12×2×2 bricks. Numeral 7 denotes a brick. Actually bar 4 is made of a single piece, but comprises grooves 5 imparting bar 4 an appearance of a structural form made of bricks 7.

Preferably, the size of a facet of a brick is about 1×1 cm, since it demonstrates the size of the cm unit.

The grooves are also used as a frame for tablet pieces, such as pieces 18, 8, 9, and 12. Of course, the form of the edges of tablet pieces must correspond to the form of the grooves.

Numeral 26 denotes a zoomed view of a connector 6. Connector 6 is a cube of 2×2 bricks. It comprises a bore 28, which is the female member corresponding to stud 24.

FIG. 3*b* schematically illustrates the structure of a bar 4 and a connecting member 6, according to another embodiment of the invention.

A connector 6 is used to connect two bars 4. The bars may be connected perpendicularly or subsequently.

According to this embodiment of the invention, the object of the design of the bars and the connectors is to allow connecting each of two bars such that the connection is concealed, thereby providing to the construction an appearance which departs from a construction made of myriad pieces. In order to achieve this object, the contour of the ends of a bar 6 and the connecting member 4 must be substantially the same.

According to embodiments of the invention, the connection technology is based on mating elements by end-to-end insertion. This is a well-known technology. According to such technology, one of the mating elements is referred to as "male" and the other as "female". In the illustrations herein, numeral 44 denotes a "male" connecting element, and numeral 28 denotes a "female" connecting element. Numeral 20 denotes a zoomed view on the "male" connecting element 44.

According to this embodiment of the invention, the male connecting element comprises only four vanes 22, in contrast to the embodiment of FIG. 3*a* in which also a stud 24 is employed. Thus, in the embodiment of FIG. 3*b* the part which mates with the corresponding female member 28 is the vanes. Accordingly, the structure of the female connecting element has to correspond to the vanes.

FIG. 4 is a cross-section along two connected bars 4, which schematically illustrates a connection mechanism according to one embodiment of the invention.

The zoomed view focuses on connector 6. In this particular case, the bars are connected perpendicularly.

FIG. 5 schematically illustrates the structure of a bar 4 and a connecting member 6, according to another embodiment of the invention.

According to this embodiment of the invention, stud 24 is a quadrate prism, in contrast to the embodiment of FIG. 3 in which stud 24 is a cylinder. The quadrate form of the stud performs the same role as vane 22 in the embodiment of FIG. 3, i.e., a certain angle between bar 4 and connector 6 is enforced.

FIG. 6 schematically illustrates the arch piece 18 of FIGS. 1 and 2, according to one embodiment of the invention.

The arch is "derived" from a tablet of the size of 10×12 bricks.

FIG. 7 schematically illustrates the "wall" piece 8 of FIGS. 1 and 2, according to one embodiment of the invention.

FIG. 8 schematically illustrates a "wall" piece 9, according to one embodiment of the invention.

The only difference between wall 8 and 9 is the decoration.

FIG. 9 schematically illustrates a "wall" piece 12, according to one embodiment of the invention.

The size of piece 12 is 4×4 bricks.

FIG. 10 schematically illustrates a bar 14, according to one embodiment of the invention.

The size of piece 14 is 4×2×2 bricks, in contrast to bar 4, the size of which is 12×2×2 bricks.

Each of FIGS. 11*a* and 11*b* schematically illustrates a "lamp" piece 10, according to one embodiment of the invention.

In FIG. 11*a* the stud 11 of lamp 10 corresponds to the size of the female member 28 of a connector 6 of FIG. 3*a*, and in FIG. 11*b* the stud 11 of lamp 10 corresponds to the size of the female member 28 of a connector 6 of FIG. 3 *b*.

FIG. 12 schematically illustrates a casing 34, for a toy building construction set.

The casing comprises a box 40, on which a scale 38 is impressed. Assuming the pieces are used layer-by-layer, scale 38 indicates the number of remaining floors that can built. For example, if the level of the pieces inside box 40 points on number 2 of the scale, it indicates that only two floors can be built from the remaining pieces in the box. A top cover 36, which moves along rails 42, is used to close box 40.

Of course, the scale may reveal how many layers have been used, rather than how many layers remain.

While certain features of the invention have been illustrated and described herein, the invention can be embodied in other forms, ways, modifications, substitutions, changes, equivalents, and so forth. The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A toy building construction set, for demonstrating building construction principles to an infant, said set comprising:

pieces in a form of bars; and pieces in the form of connectors, for simulating a concrete construction skeleton and having characteristics of a concrete skeleton, wherein each of said bars has only male connecting members at an end thereof, each of said connectors having at each facet thereof a female connecting member corresponding to said male connecting member, and wherein said bars and connectors have the same cross-sectional width, so that when a connection is made by end-to-end insertion of each of said bars into each of said connectors, said bars and said connectors cannot be distinguished from one another.

2. A set according to claim 1, wherein said male connecting member comprises at least one vane, and said female connecting member further comprises at least one corresponding depression, thereby enforcing connecting a bar of said bars to a connector of said connectors in a desired angle therebetween.

3. A set according to claim 1, wherein said male connecting member comprises a stud.

4. A set according to claim 3, wherein said stud is of a cylindrical form.

5. A set according to claim 3, wherein said stud is of a prismatic form.

6. A set according to claim 1, wherein said stud is of a quadratic prism form.

7. A set according to claim 1, wherein each of the pieces having at least one groove along said piece, and at least one groove across said piece.

8. A set according to claim 1, further comprising a plurality of quadrate tablets, to be placed such that the grooves of the surrounding pieces are used as a frame thereof.

9. A set according to claim 1, further comprising a plurality of rectangular tablets, to be placed such that the grooves of the surrounding pieces are used as a frame thereof.

10. A set according to claim 1, wherein a latitudinal contour of at least one of the pieces is quadrate.

11. A set according to claim 1, wherein a latitudinal contour of at least one of the pieces is rectangular.

12. A set according to claim 1, wherein at least one of the facets of the pieces thereof is divided by grooves for imparting an appearance of a structural form made of bricks.

13. A set according to claim 12, wherein each of said bricks is in a size of about 1×1 cm.

14. A set according to claim 1, further comprising at least one tablet.

15. A set according to claim 1, further comprising a lamp piece.

16. A set according to claim 15, wherein said lamp piece having a male connecting member corresponding to the female connecting member of a connector.

17. A set according to claim 1, further comprising a casing for storing the pieces of said set.

18. A set according to claim 17, wherein said casing further comprises a scale for indicating the number of floors that can be built by the remaining pieces in said casing.

* * * * *